US006460204B1

(12) United States Patent
Krist et al.

(10) Patent No.: US 6,460,204 B1
(45) Date of Patent: Oct. 8, 2002

(54) ASSEMBLY UNIT FOR SANITARY FACILITIES

(75) Inventors: Dieter Krist, Winnenden; Bernd Hanel, Fellbach, both of (DE)

(73) Assignee: E. Missel GmbH, Stuttgart (DE)

( * ) Notice: Subject to any disclaimer, the term of this patent is extended or adjusted under 35 U.S.C. 154(b) by 0 days.

(21) Appl. No.: 09/390,884

(22) Filed: Sep. 7, 1999

(30) Foreign Application Priority Data

Sep. 8, 1998 (DE) ..... 198 40 996
Feb. 24, 1999 (DE) ..... 199 07 963

(51) Int. Cl.[7] ..... A47K 4/00
(52) U.S. Cl. ..... 4/663; 4/252.3; 4/645; 4/664
(58) Field of Search ..... 4/252.1, 252.2, 4/252.3, 645, 670, 663, 664, 695, 696; 52/34

(56) References Cited

U.S. PATENT DOCUMENTS 1,930,314 A * 10/1933 Healy et al. ..... 4/645 X
2,159,021 A * 5/1939 Groeniger ..... 4/252.3
2,198,605 A * 4/1940 Faber ..... 4/663
2,264,082 A * 11/1941 Kintz ..... 4/252.3 X
2,716,757 A * 9/1955 Eriksson ..... 4/645
2,901,780 A * 9/1959 Rothenstein ..... 52/34

* cited by examiner

*Primary Examiner*—Robert M. Fetsuga
(74) *Attorney, Agent, or Firm*—Townsend and Townsend and Crew LLP

(57) ABSTRACT

An installation unit for sanitary fixtures is described which is characterized by a central carrying column having at least two connection regions with a planar, angled and/or curved attachment surface which extend at an angle to one another or parallel to one another, and which are in particular diametrically opposite relative to one another.

19 Claims, 18 Drawing Sheets

ASSEMBLY UNIT FOR SANITARY FACILITIES

BACKGROUND OF THE INVENTION

1. Field of the Invention

The invention relates to an installation unit for sanitary fixtures in particular in the form of WC (water closet), washstand, bathtub, shower, bidet, urinal and the like.

2. Description of the Prior Art

In accordance with customary installation techniques, sanitary fixtures are directly mounted on a room wall, on forewall constructions and—insofar as one concerned with bathtubs and shower tubs—in room corners. In practice, this frequently leads to a situation in which an ideal exploitation of the space is not possible as a result of the actual circumstances of the room, in which problems basically arise in small rooms with respect to the accommodation of the sanitary fixtures which are absolutely necessary and generally in that the design possibilities for sanitary rooms leave something to be desired.

SUMMARY OF THE INVENTION

The object of the invention is thus to provide an installation unit which provides a high degree of freedom with respect to the scope for design given to architects and planners, while departing from the known installation of sanitary fixtures in a sequential manner along the walls of the room, and also permits an ideal exploitation of even very small spaces, permits a reduction and simplification of the conventional installation times and also a lowering of the building costs and enables a gain in living area as a result of the freedom of design which is provided.

This object is satisfied in accordance with a first embodiment by a central carrying column having at least two connection regions with a planar, angled and/or curved attachment surface which extend at an angle to one another or parallel to one another, and which are in particular diametrically offset relative to one another, and also, in accordance with a second embodiment, by at least one foundation which can be secured at the floor side and onto which at least two vertically extending module carriers are attached and with at least one functional module which can be coupled in shape-matched and/or force transmitting manner to the module carriers and forms a stable assembly together with the foundation and the module carriers.

Through this basic conception, a multivalent, compact sanitary column is obtained which enables the reception of a plurality of sanitary fixtures in different combinations and which is variable with respect to its location and can accordingly be installed both on a wall or also in a corner of a room as well as free-standing in the room.

The functional modules consist preferably of a WC flushing unit and/or of a washstand connection unit and/or of connection units for tub or shower fittings and/or of a tube module and they have at least in part a polygonal, in particular triangular, peripheral contour, with the carrying elements of the functional modules being formed as hollow sections and preferably being arranged in corner regions of these functional modules.

Of significance for the central carrying column formed in accordance with the invention is the fact that a storage container for the WC is integrated into a part region of the inner space or of the inner spaces of the overall column, has a more compact shape in comparison to the customary storage containers of parallelepiped shape and preferably has a tubular, triangular shape or a shape generally matched to the inner contour of the respective receiving space. The reduction in volume in comparison to customary flushing systems of parallelopiped shape results, amongst other things, also from the fact that as a result of the shaping and of the arrangement of functional elements above one another one can operate in the storage container with a reduced air volume above the maximum water level.

The further inner spaces or shafts in the carrying column can be used to accommodate supply and disposal lines and also for the line guidance to the individual sanitary fixtures.

The carrying column itself is preferably decoupled with respect to structure-borne noise throughout in a manner which is independent of later workers and which necessarily enters into effect when installation is completed; i.e. the erection, the attachments and the connection of all elements, fittings and lines takes place in a manner decoupled with respect to structure-borne noise.

As a result of the predeterminable position of the mounting surfaces for the sanitary fixtures on the carrying column, pleasantly shaped, space-saving arrangements can be achieved both with respect to the desired layout and also with respect to the utilization of space since it is possible in accordance with the invention to equip the carrying column with attachment surfaces distributed around it in problem-free manner so that two or three sanitary fixtures and even four sanitary fixtures, with free-standing installation of the carrying column in space, can be mounted as desired, and indeed not only at a right angle to one another but also at a correspondingly changed angle when correspondingly utilizing an obliquely extending attachment surface.

The part units of the carrying column associated with the individual sanitary fixtures can not only be individually put together to form the total column and connected together, but rather they can also have different height which is of advantage for the practical use and also for the design aspect.

When the carrying column is designed in a skeletal manner of construction provision is made for the column to be capable of being clad without problem with a tile carrier, and any desired building materials such as construction boards, composite materials or porous concrete can be considered and naturally also a cladding with plates of marble, plastic, wood, glass and all other suitable materials can take place.

If expedient for reasons of adaptation to different room heights or also for design reasons, the carrying column can also be designed to be of variable height as a whole or in some regions, for which purpose the frame of the carrying column, which is for example built up of square tubes, can be made telescopic and latchable.

In connection with new buildings in particular it is also possible to make the central carrying column extend continuously over a plurality of stories, with the carrier column being exploited in a story-bridging manner for the guidance of supply and disposal lines of all kinds. In this arrangement the carrying column is secured in a manner decoupled with respect to structure-borne noise in the respective story break-through.

Through the design of the foundations and of the module carriers associated with them, it is possible to install the functional modules accurately in position in an extremely simple manner in that the functional modules are plugged onto the module carriers and are at least fixed in force transmitting manner. In this way, a stable assembly is provided through the cooperation of the foundation, module carriers and functional modules which in the totality of the installation unit can also be rigidified by stabilizing elements such as struts, tensioning cables and the like, which can be coupled to the hollow sections of the functional modules and which permit the functional modules to be connected to one another and/or to a wall. Finally, at least the WC functional module is additionally designed such that it can itself be connected to the respectively adjoining wall.

The module carriers provided on the foundations can have different height, whereby an adaptation to the installation circumstances, i.e. to the different height dimensions of functional modules, is possible. In order to increase the variability of the overall arrangement the module carriers can be adjustably attached to the respective foundation.

The foundations preferably consist of straight and/or curved or aerially formed foundation elements which are in particular fixable relative to one another at predeterminable angles, so that all circumstances which arise in practice can also be taken into account.

Further advantageous embodiments and special features of the invention will be set forth in the following with reference to embodiments and will be explained in more detail with reference to the drawings.

In one embodiment, an installation unit for sanitary fixtures, in particular in the form of WC, washstand, bathtub, shower, bidet, urinal, pipes and the like, is provided. The installation unit comprises at least one foundation which can be secured at the floor side onto which at least two vertically extending module carriers are attached and with at least one functional module which can be coupled in shape-matched and/or force transmitting manner to the module carriers and forms a stable assembly together with the foundation and the module carriers. The functional modules have, at least in part, a polygonal and in particular triangular peripheral contour and the carrying elements of the functional modules are formed as hollow sections and are preferably arranged in the corner regions of the functional modules. The hollow sections can be coupled to the module carriers via shape-matched and/or force transmitting plug-in/clamping connections and can preferably be attached to the module carriers so that their spacing to the foundation is adjustable. For the formation of the installation unit or a carrying column, a foundation with two straight foundation elements extending at an acute angle, in particular at an angle of 45°, is provided and is coupled via their system carriers to a plurality of functional modules, with a functional module being arranged in the acute angled corner region between the two foundation elements and being connected to system carriers of both foundation elements.

DETAILED DESCRIPTION OF THE INVENTION

Figure 1:
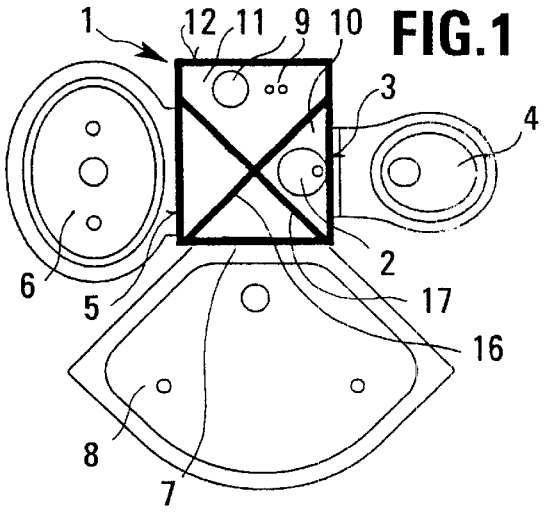
FIG. 1 illustrates an arrangement in a schematic plan view of an embodiment of the central carrying column of the invention in conjunction with three sanitary fixtures attached thereon.

FIG. 1 shows a rectangular carrying column with an integrated compact flushing tube 2 and also a first mounting surface 3 for a toilet bowl 4, a second attachment surface 5 disposed parallel thereto and opposite to it, a washstand and a third attachment surface 7 arranged between them for a shower tub 8 and extending at an angle of 90° to the two said attachment surfaces 3, 5.

In the interior of the carrying column 1, different regions are provided, in particular an inner region 10 for the compact flushing tube 3 and also a supply shaft 11 for the reception of supply and disposal lines 9.

A subdivision of the total inner space of the carrying column 1 can take place by two subdividing walls 16 and 17 extending preferably at right angles to one another. These do not have to be closed walls, but rather this subdivision can also be realized by open frame constructions which endow the total column with additional stability or increase its stability.

The carrying column of FIG. 1 is provided and designed for wall attachment and has for this purpose a wall connection surface 12.

The mounting surfaces 3, 5, 7 are so formed that they can be equipped with sanitary elements of practically all manufacturers in the market place; i.e. different washstands or in-built basins, WCs, urinals, bidets, bathtubs and shower tubs of any desired manufacturer can be installed without problem.

Since the central carrying column 1 preferably consists of a frame construction, in particular of a welded construction, the pipe runs and branches required are simple to realize and can be adapted to the respective circumstances.

In accordance with an advantageous possibility of design of the invention the central carrying column can be assembled in module-like manner from like triangular and/or rectangular or multi-cornered columns. This modular manner of construction makes it possible to provide a maximum of possibilities with a minimum of different units, and indeed in dependence on the respective requirement and always with a low installation complexity. In the case of modular construction, the stockholding can moreover be simplified, since the respectively desired central carrying column can be assembled from the part columns in dependence on the requirement.

A further important aspect of the design of the central carrying column lies in the fact that each column is decoupled with respect to structure-borne noise throughout in a manner which is independent of the worker and is always fully effective; i.e. the mounting and attachment of the carrying column and also the connection of all elements, fittings and lines is designed in a manner decoupled from structure-borne noise.

Figure 2:
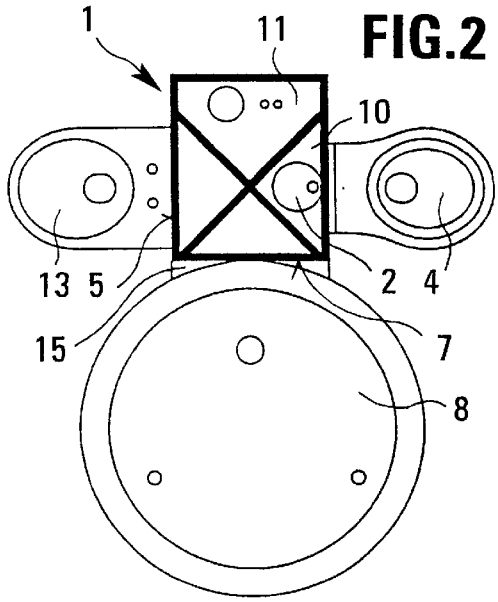
FIGS. 2–5 illustrate further layouts and combinations of a central carrying column and sanitary fixtures.

FIG. 2 shows a variant similar to the embodiment of FIG. 1 with the same carrying column 1 which is, however, equipped with a bidet 13 mounted on the attachment surface 5 instead of a washstand. In the embodiment of FIG. 2 a model variant in comparison to FIG. 1 is also shown with respect to the shower tub 8, namely a round tub, which is in particular connected to the attachment surface 7 via an intermediate carrier element. This variant already makes it clear that the attachment surfaces 3, 5, 7 are preferably of the same design and make it possible to attach different sanitary articles. This can in each case take place directly or, if required, via suitable adapters or intermediate carrier elements.

Figure 3:
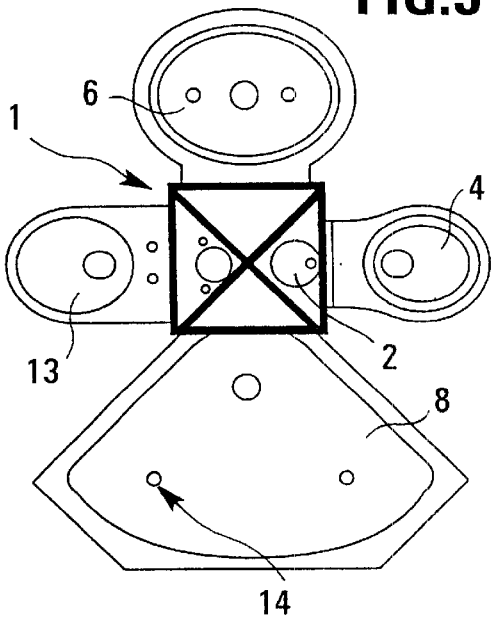

FIG. 3 again shows a substantially rectangular carrying column 1 which in this case is especially of square cross-section and which is provided for free-standing installation in a room. As a consequence, four attachment surfaces for sanitary fixtures are available in this case, namely for a WC 4, a washstand 6, a bidet 13 and a shower tub 8. In connection with the shower tub 8 its support feet 14 are also shown in FIG. 3.

With regard to the positioning of the different sanitary fixtures on the attachment surfaces of the central carrying column 1 freedom of choice exists, so that not only spatial but also design aspects can be taken into account.

Figure 4:
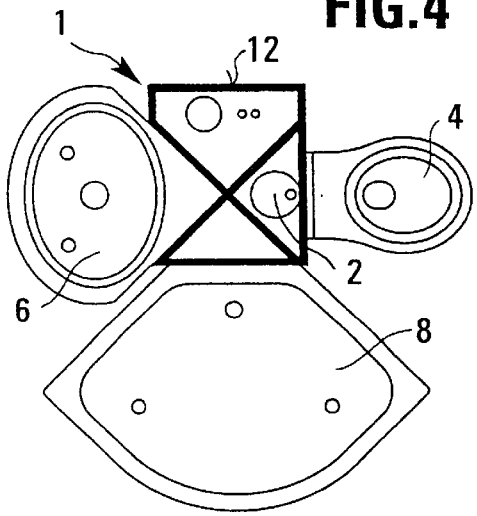

FIG. 4 shows a carrying column 1 again intended for wall installation via the wall connection surface 12 and in this case the carrying column 1 is not of rectangular shape in cross-section, but rather has a triangular recess at the side associated with the washstand 6 resulting from the design of the carrier construction or the selection and combination of the eventually used module elements. In this manner, an additional washstand shelf surface can be provided and, on the other hand, the aesthetic slenderness of the column construction can be promoted.

Figure 5:
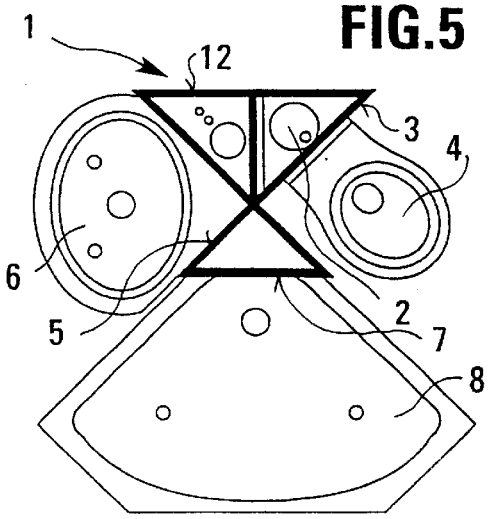

FIG. 5 shows a variant of a carrying column, again intended for wall attachment, the carrying column 1 being assembled from at least three substantially like part units which are each of right-angled cross-sectional shape. It can be seen from this design that sanitary fixtures, i.e. in the present case the WC body 4, can be obliquely positioned, whereby a particularly harmonious incorporation into the total assembly can be achieved, on the one hand, and a gain in space can also be achieved, on the other hand, since the overall peripheral contour of the central column equipped with sanitary articles can be made even more compact.

Figure 6:
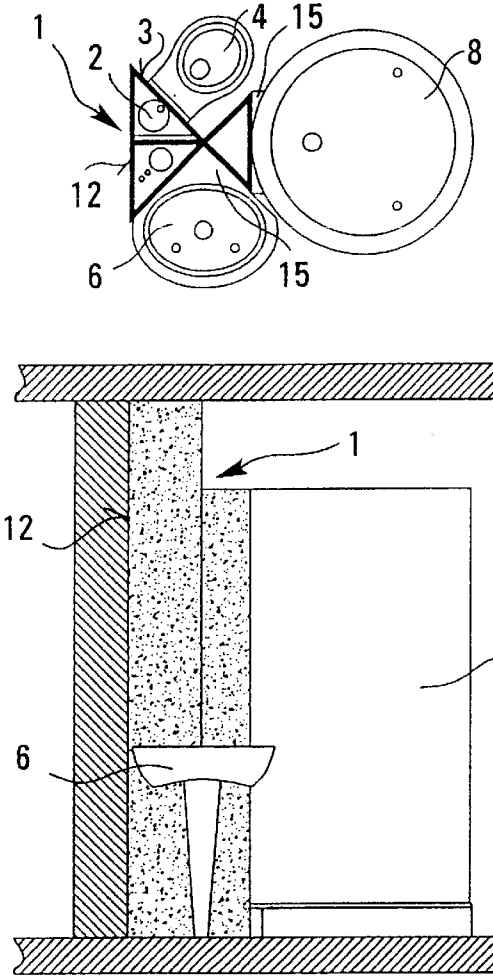
FIGS. 6–8 illustrate a detailed embodiment of a carrying column secured to a wall with shower tub, WC and washstand, respectively with a front view and two side views.
Figure 7:
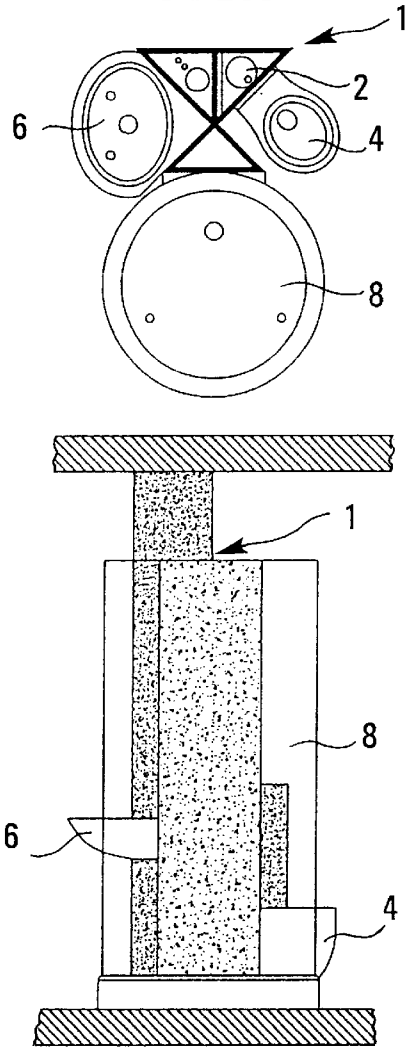
Figure 8:
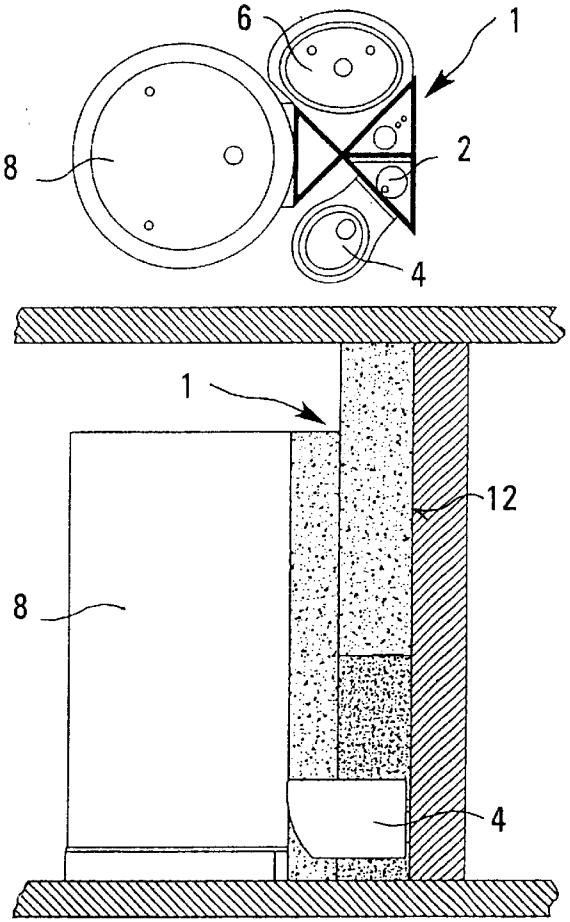

FIGS. 6, 7 and 8 show the carrying column 1 illustrated in FIG. 5 equipped with a round shower 8 and also a washstand 6 and toilet bowl 4 in different views.

The outline illustration respectively shown above the room illustration allows the compactness of the overall arrangement to be recognized and makes it clear that by the various part regions of the carrying column 1 essentially only the practically compulsory intermediate spaces are taken up room-wise between the individual sanitary fixtures. Through this compact arrangement a multi-functional island is provided in the respective room, with the individual sanitary components not hindering each other, but rather, on the contrary, with these individual elements being advantageously separated or partitioned off from one another.

The illustrations in FIG. 6 show the carrying column 1 secured to the wall via the wall connection surface 12, with the washstand 1 and the round shower 8 being visible. It can be seen that the part unit of the carrying column 1 associated with the round shower 8 does not extend up to the ceiling but is rather matched to the height of the shower 8.

The front view shown in FIG. 7 allows it to be seen that the part unit of the carrying column 1 associated with the obliquely disposed toilet bowl also has a reduced height and is only made so high as is required having regard to the integrated compact flushing tube 2. The washstand 6 is installed at the usual height and attached using an intermediate carrier element 15 which ensures a form-fitted connection to the carrying column 1 and also an enlarged shelf surface.

The side view of FIG. 8 again shows the round shower 8 and also the toilet bowl 4 as well as the mounting of the carrying column 1 to the wall of the room via the wall connection surface 12.

FIGS. 9 to 12 make clear the possibilities of a space-saving arrangement of a toilet bowl 22 in conjunction with a bath or shower tub in the smallest rooms.

Figure 9:
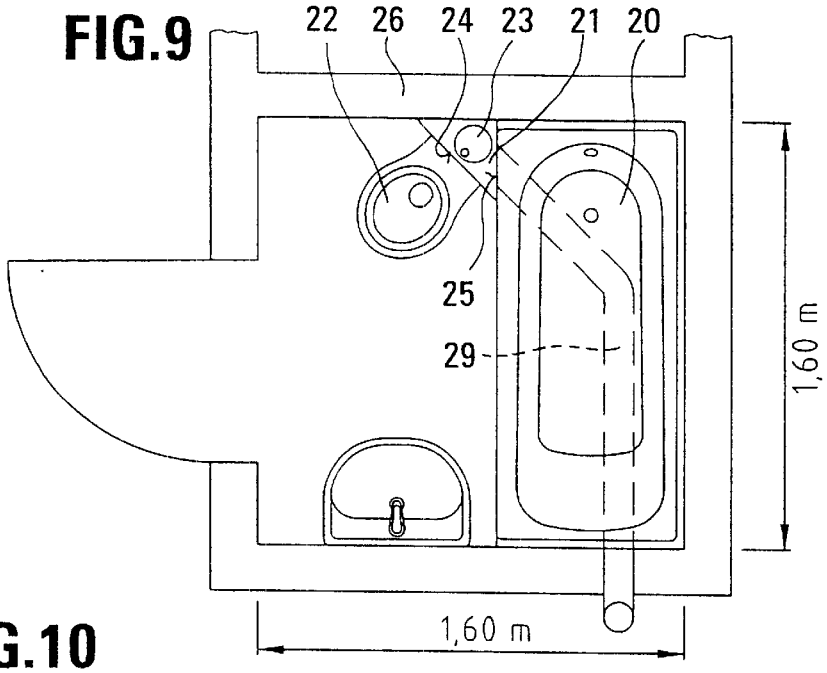
FIGS. 9–12 illustrate basic outline representations of small rooms equipped with sanitary fixtures with a WC in each case diagonally positioned in the room.
Figure 10:
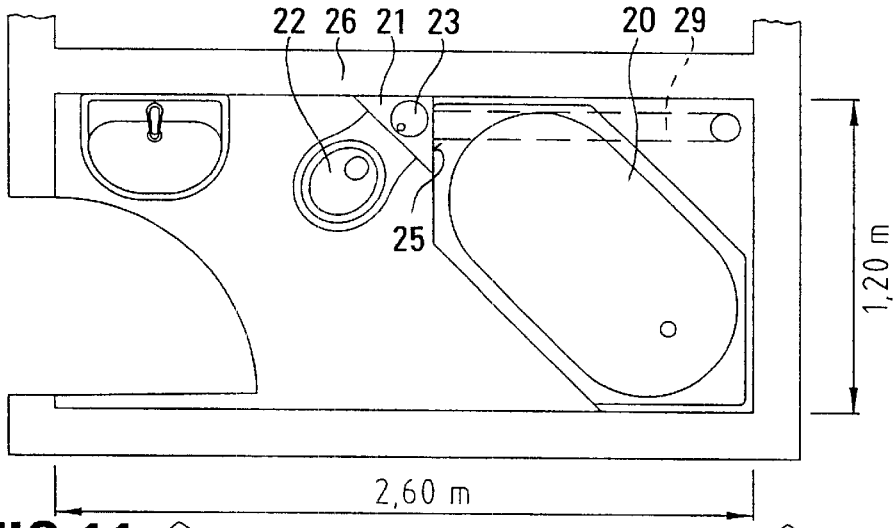
Figure 11:
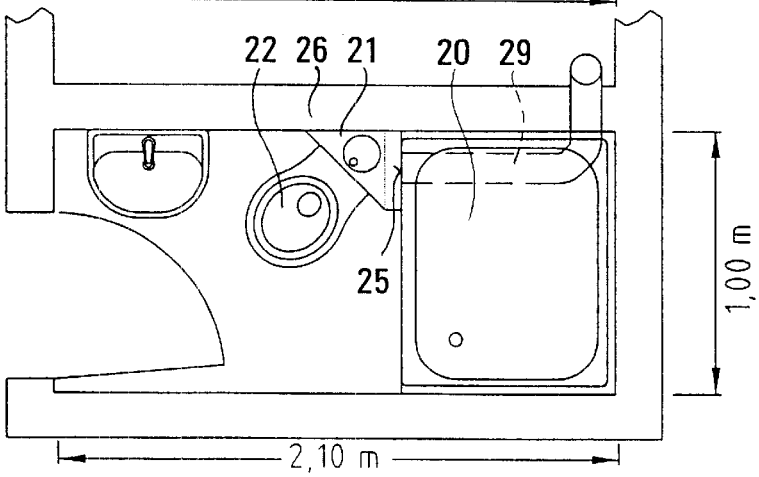
Figure 12:
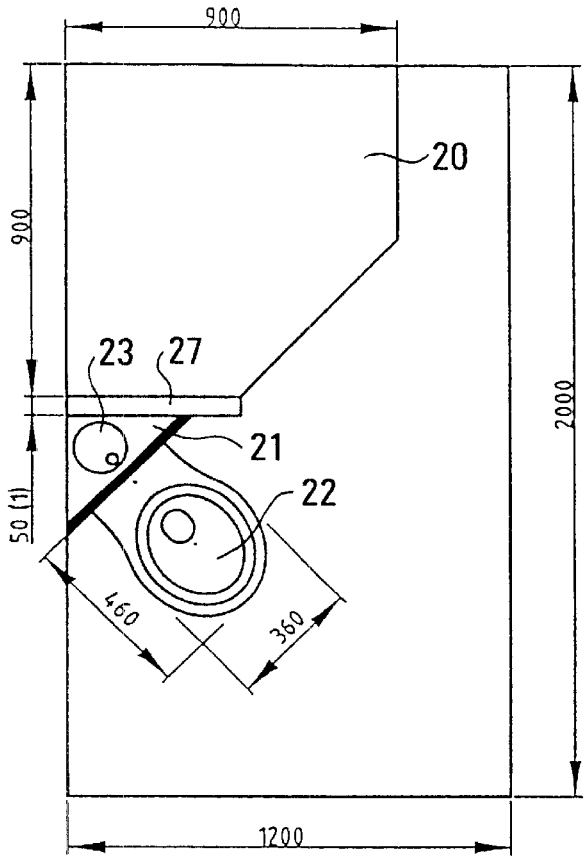

In FIG. 9 a bathtub 20 extends over the entire width of the room. In FIG. 10 a bathtub 20 is arranged obliquely in a corner of the room with an even smaller width of the room. In FIG. 11 a shower tub is provided at one end of the room and in FIG. 12 there can be seen a shower tub 20 arranged in a corner of the room. In all these circumstances the positioning of the toilet bowl 22 is characterized by the fact that the toilet bowl 22 is secured to a triangular-shaped carrier 21 with an integrated storage container or compact flushing tube 23 and indeed via an attachment surface 24.

The space existing between a respective side boundary surface 25 of the bathtub or shower tub 20 and a room wall 26 is exploited to receive the carrier unit 21, which is of triangular cross-section, so that it is possible in this manner and in a particularly space-saving way to position the toilet bowl 22 obliquely to the room wall or diagonally in the remaining space, i.e. to position it in the space not taken up by the tub 20, and in this manner to gain space in the remaining room. As a result of this arrangement at least the disposal line 26 for the WC can be routed within the tub cladding and it would also be possible to replace the water supply and to conduct it directly into the carrier unit 21 should no corresponding wall connection be available.

In FIGS. 9 to 11 the room dimensions are given in order to make it clear how extremely favorable arrangement possibilities are provided by the design of the invention.

Figure 13:
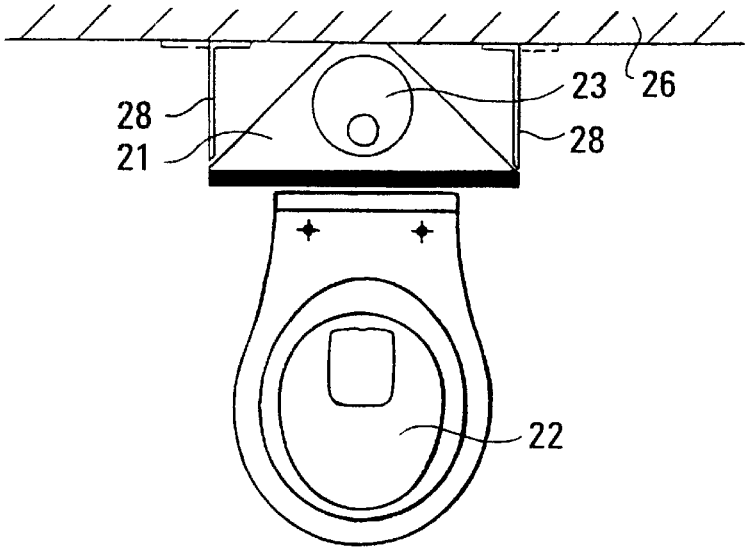
FIG. 13 illustrates a schematic plan view of a WC carrier unit with a triangular basic unit in an embodiment intended for direct mounting on the wall and which accommodates a storage container in the form of a compact flushing tube.

FIG. 13 shows a possible adaptation of a carrier unit 21 of approximately triangular cross-section with an integrated compact flushing tube 23, i.e. a container matched formwise to the carrier unit, for a customary wall mounting.

For this purpose only suitably adapted mounting angles 28 are required which bring about the required stable attachment and these mounting angles can in turn be clad in known manner, so that tiling, for example, is possible. The free inner space which results can also be exploited in that a cupboard-like design or cladding is provided.

The variant indicated makes it clear that starting from the triangular shape of the carrying unit 21, which is advantageous in many installation cases, a parallelopiped shape suitable for normal installation can also be realized without problem, so that with one common basic unit all the requirements which arise in practice can be taken into account.

Figure 14:
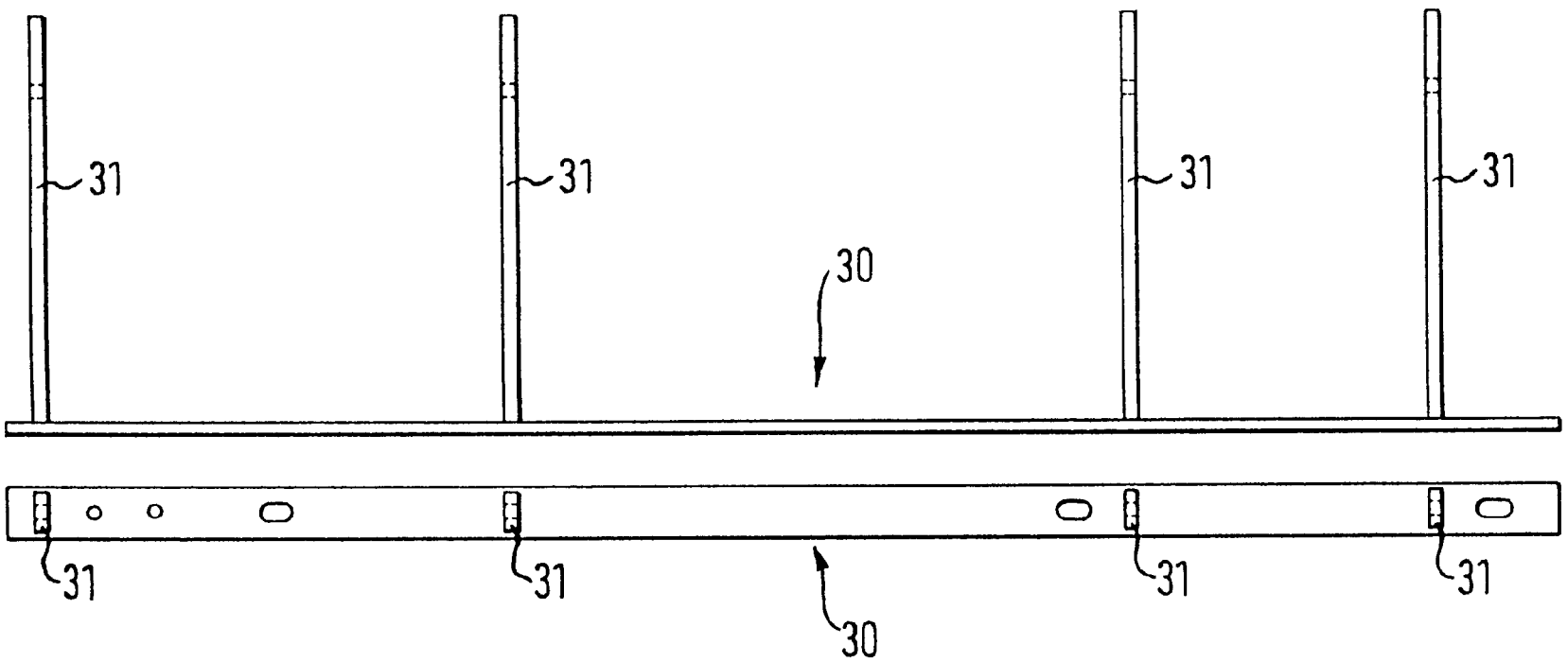
FIG. 14 illustrates a schematic side view and plan view of a foundation.

The schematic illustration of FIG. 14 shows in elevation a foundation 30 with vertically extending module carriers 31 mounted thereon as well as a plan view of this foundation 30 which is designed in this embodiment as an elongate body of rectangular cross-section.

The module carriers 31 are likewise of rectangular cross-section and can have different heights, and indeed in dependence on the design of the functional modules to be coupled to them.

The foundation 30 is provided with a plurality of bores or through-openings for mounting members by means of which the respective foundation is fixed, preferably to the rough concrete floor.

Figure 15:
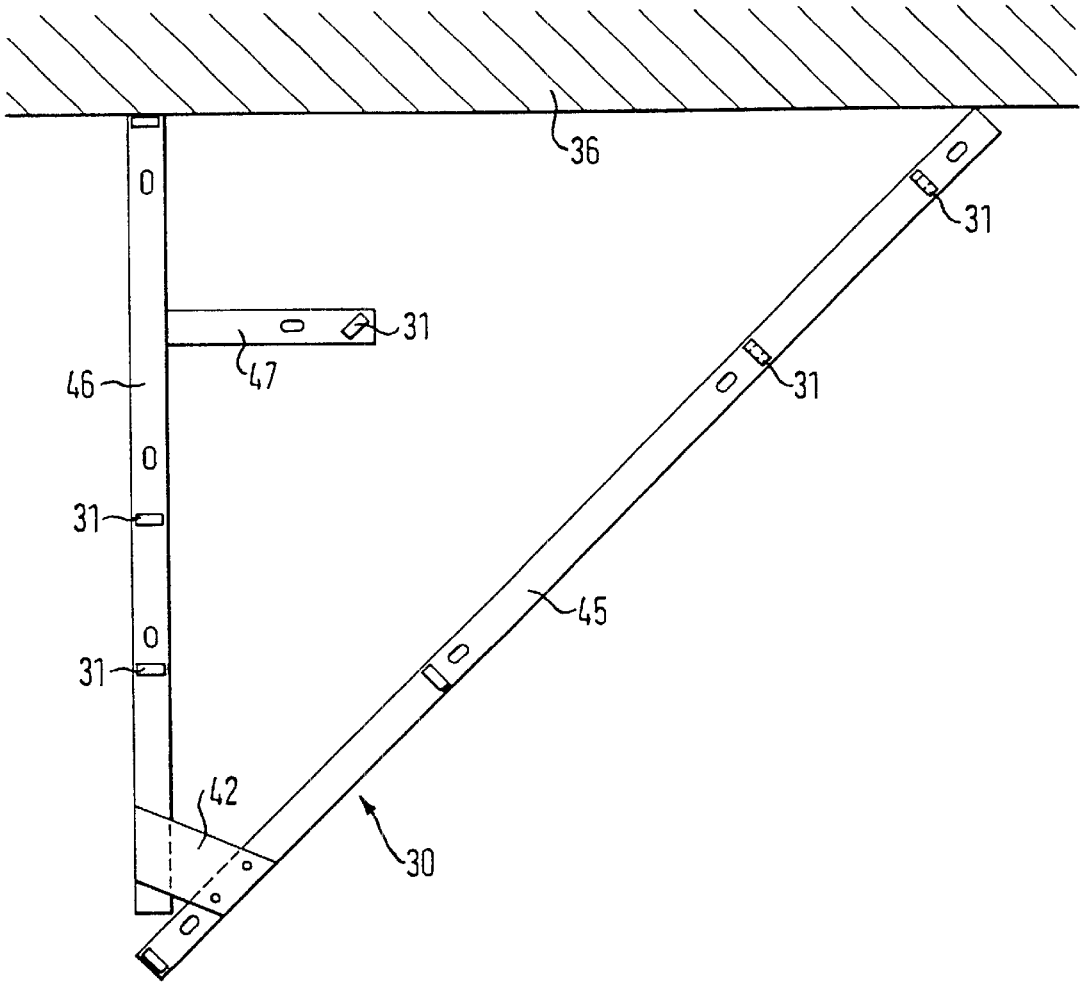
FIG. 15 illustrates a plan view of a possible foundation design.

FIG. 15 shows in plan view an embodiment of a foundation 30 which is put together from a foundation element 45 extending obliquely to a wall 36, a foundation element 46 extending perpendicular to the wall 36 and a further short foundation element 47 which extends perpendicular to the foundation element 46 and into the interior of the foundation. The two foundation elements 45, 46 are connected at their ends remote from the wall via a connection lug 42, with this connection lug 42 preferably being fixedly attached to one foundation element and being capable of being screwed to the other associated foundation element. In this way, the predetermined relative position of the foundation elements is defined in a fixed manner, so that during the installation only the positioning of the foundation 30 relative to the wall 36 is necessary.

Figure 16:
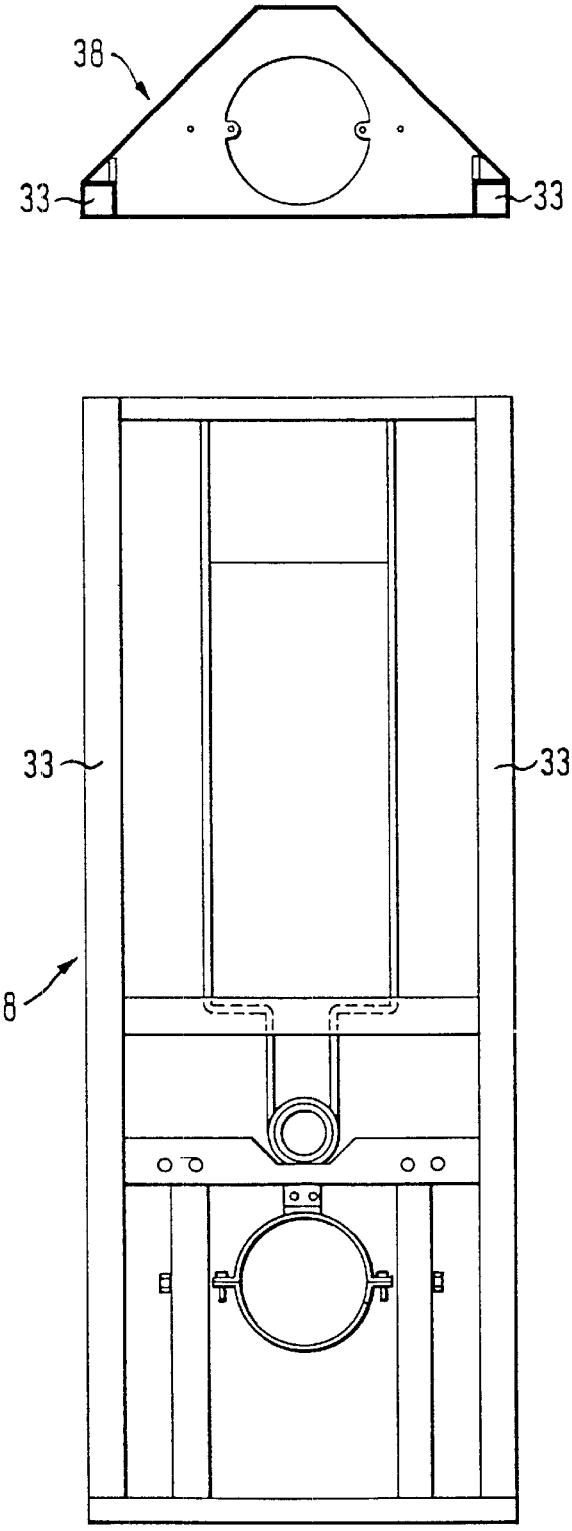
FIG. 16 illustrates a plan view and front view of a functional WC module.

FIG. 16 shows in a front view and in a plan view a functional module in the form of a WC flushing unit 38 which is of substantially triangular design in cross-section and has a respective hollow sectional carrier 33 in the corner regions at the front side. Via these hollow sectional carriers 33, this functional module can be plugged onto the correspondingly positioned module carriers 31 and clamped to them. Moreover, this functional module is so designed that it can also be directly secured to the wall in a position adjoining a wall.

Figure 17:
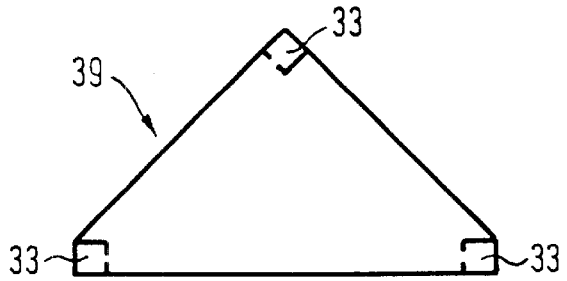
FIG. 17 illustrates a plan view and front view of a functional washstand module.
Figure 17:
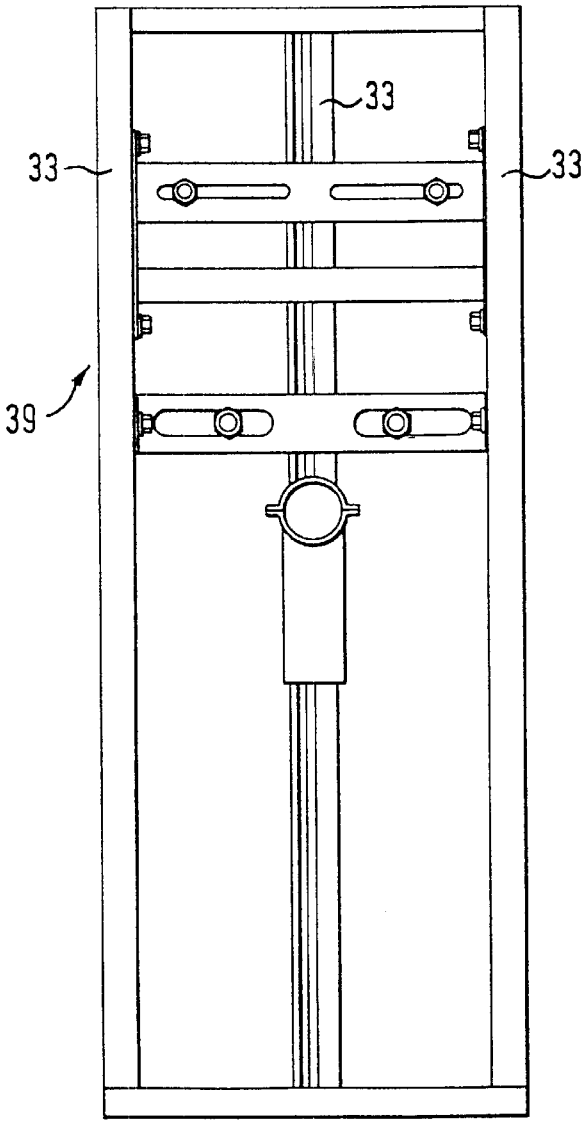

FIG. 17 shows in a front view and in a plan view a functional module formed as a washstand connection unit 39, which is likewise of substantially triangular shape in cross-section and has hollow sections 33 in the corner regions which are intended for the reception and clamping of module carriers 31.

Figure 18:
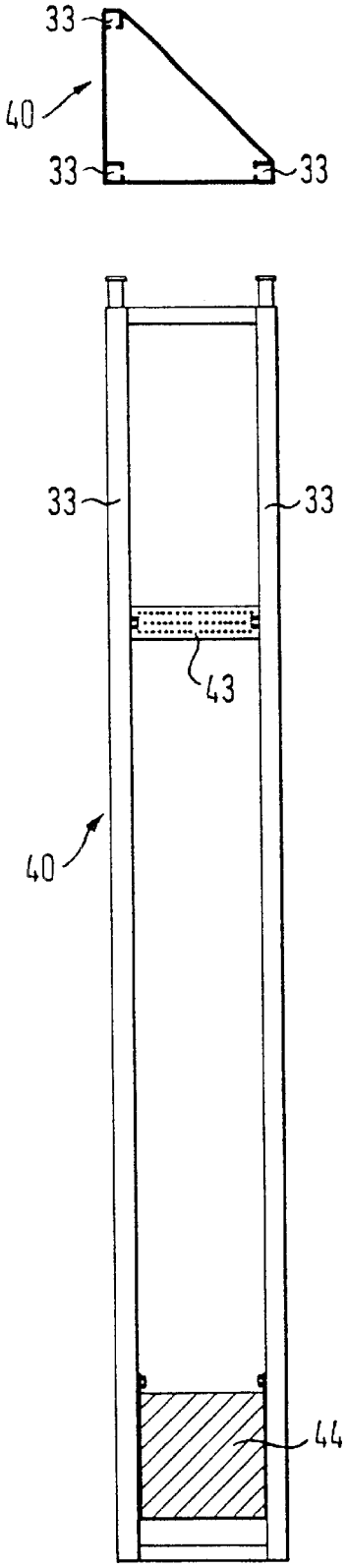
FIG. 18 illustrates a plan view and front view of a functional fitting module.

FIG. 18 shows in a front view and in a plan view a functional module which is formed as a connection unit 40 for a tub or shower fitting and is again of substantially triangular shape in cross-section. Hollow section carriers 33 are in this case also provided in the corner regions of the triangular cross-section into which relatively short module carriers can be introduced and can be clamped to the hollow sections. This functional module has a vertically adjustable mount 43 for the respective fitting and in the lower part a mounting surface 44 integrated into the functional module is shown, by way of example, which can, for example, be used as a bolt-mounting surface.

Figure 19:
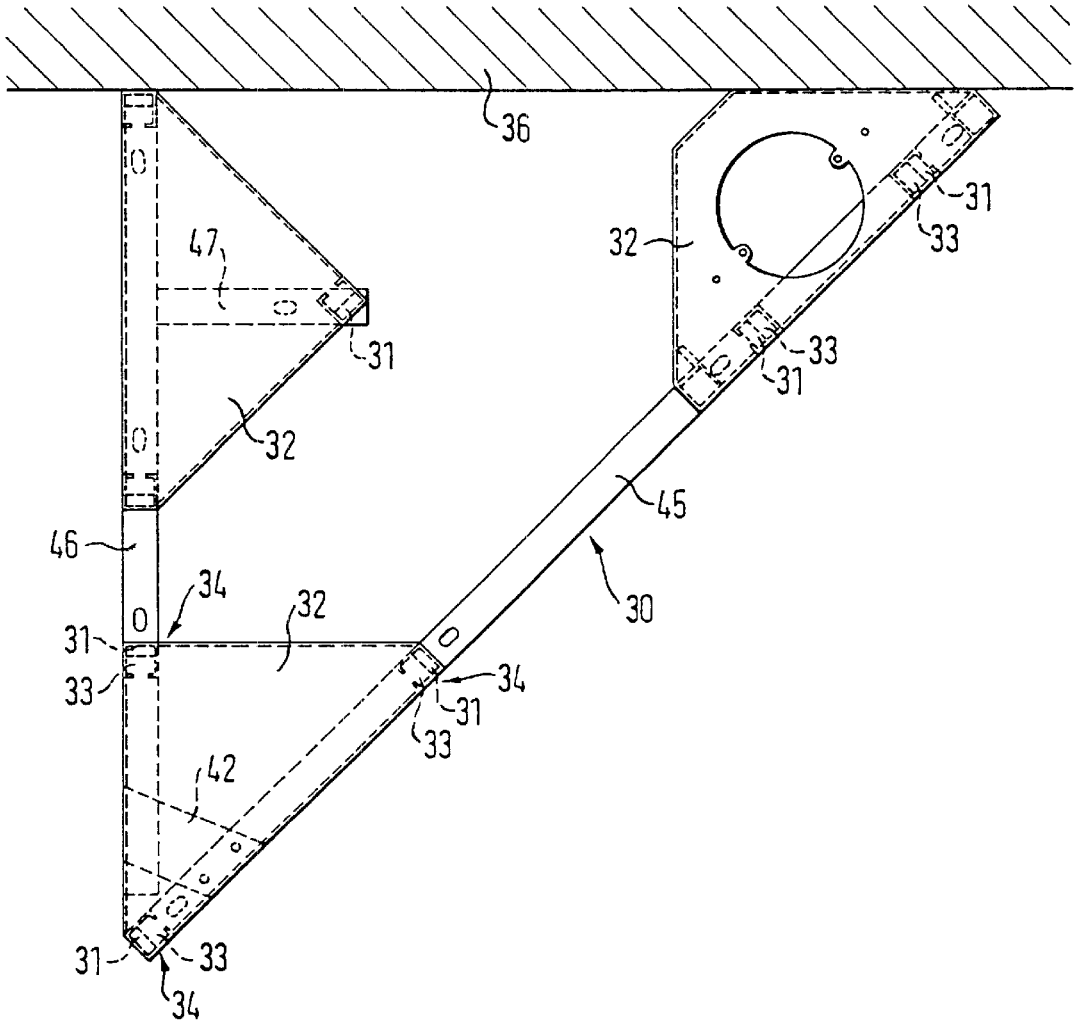
FIG. 19 illustrates a plan view of the foundation of FIG. 25 after the installation of functional modules.

FIG. 19 shows the foundation 30 of FIG. 15 after having been equipped with three functional modules 32. The functional module 32 disposed in the wall side corner is in this embodiment a WC flushing unit, the functional module 32 disposed in the front region of the foundation 30 is a washstand connection unit and the remaining functional module is a connection unit for a tub or shower fitting. A functional module 32, such as one disposed in the front region of the foundation 30 and/or the remaining functional module, includes side surfaces 35 that extend at an angle of approximately 90° to one another.

Whereas the WC flushing unit disposed at the wall side is coupled to two modular carriers 31 of the foundation element 45 and is additionally secured to the wall 36, the functional module 32 disposed in the region where the foundation elements 45, 46 are brought together is coupled to two module carriers 31 of the obliquely extending foundation element 45 and to one module carrier 31 of the foundation element 46 extending perpendicular to the wall 36, whereby this corner region is particularly stabilized. The hollow sections 33 of the functional modules 32 are preferably formed in the manner of a C-section in which the module carriers engaging in preferably form-fitted manner into the hollow sections 33 can be fixed at the respectively desired height via suitable fastening and clamping elements not shown in the drawing. As a result of these plugged/clamped connections 34 a rapid and exact installation of the total system is ensured while guaranteeing the required variability with regard to the vertical adjustment of the functional modules.

Figure 20:
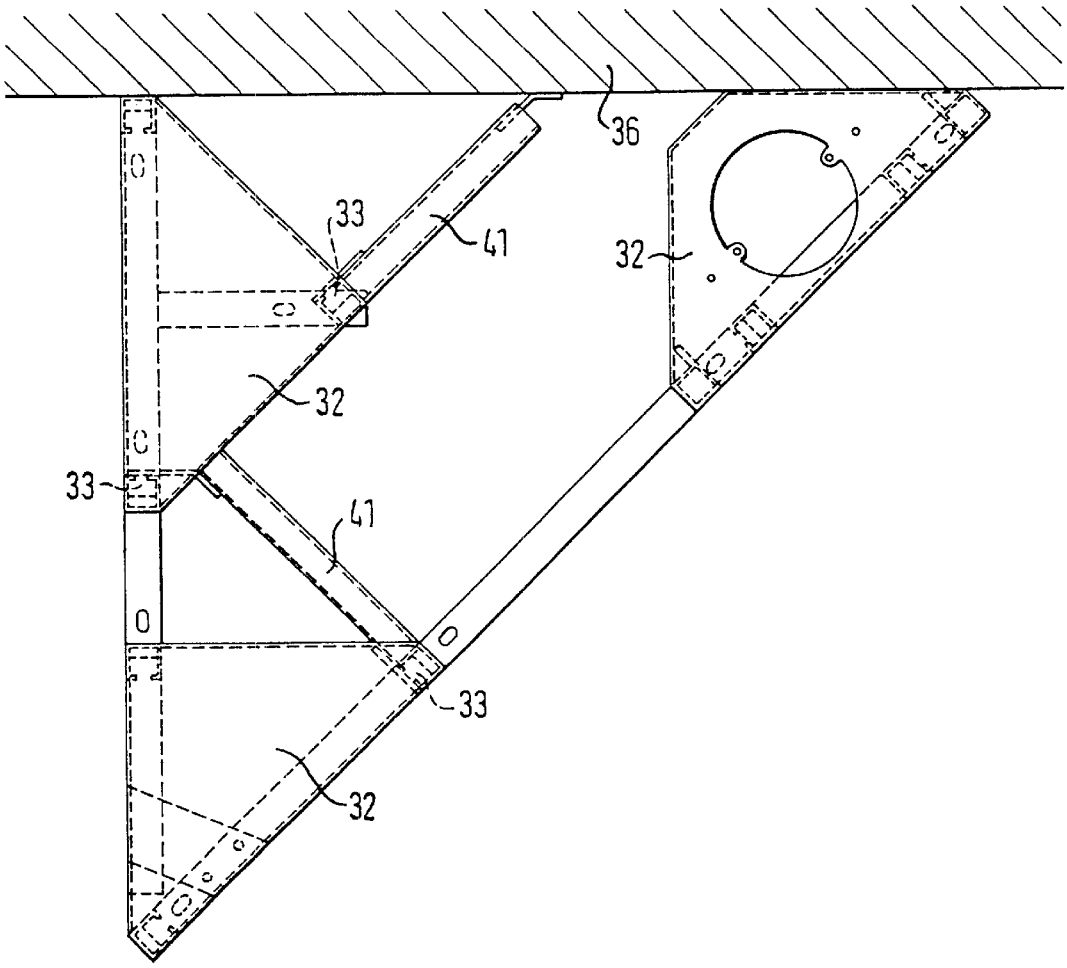
FIG. 20 illustrates the arrangement of FIG. 19 provided with additional stabilizers.

FIG. 20 shows the arrangement of FIG. 19 supplemented by stabilizing elements 41 which can be connected directly via suitable lugs to the hollow sections 33 of the functional modules 32 so that a mutual bracing can be achieved between functional modules 33 or functional modules on the wall 36 and thus a stiffening and stabilization of the total construction.

It is favorable in this respect that, as a result of the coupling between the stabilizers 41 and the hollow sections 33, the stabilizers 41 can be attached at the respectively ideal height. Struts, tension cables and the like can be used as a stabilizers.

Figure 21:
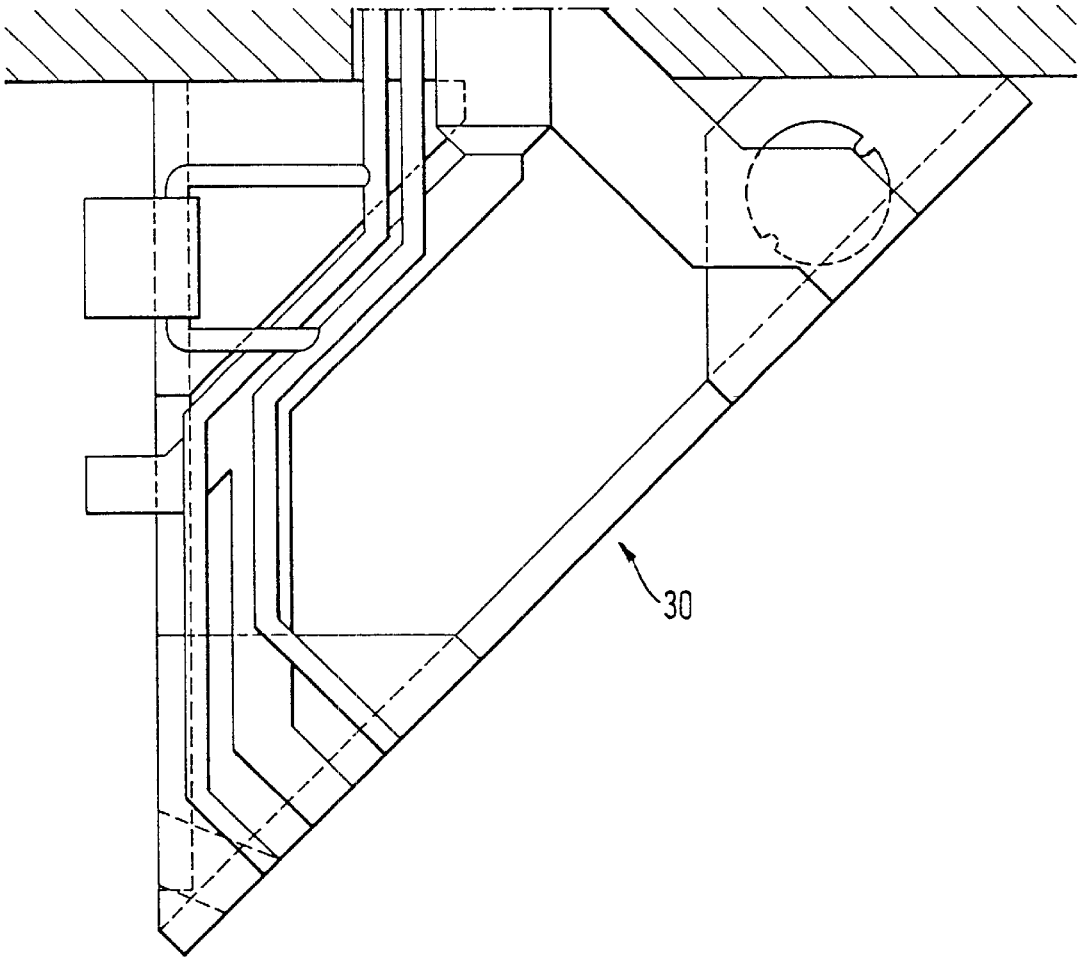
FIG. 21 illustrates the arrangement of FIG. 19 with schematically drawn-in piping.

FIG. 21 serves to explain the routing of the pipes in the inner region of the foundation 30, with the pipes provided here at the floor side extending to the corresponding connection points. It can be seen that adequate space is available within the foundation 30, or within the unit built up on this foundation, in order to accommodate the pipes and that above all the length of the pipes that are required can be minimized. Vertically extending pipes, such as for example waste water pipes, can be laid in the remaining free region and can be secured to the elements, for example to the shower element.

Figure 22:
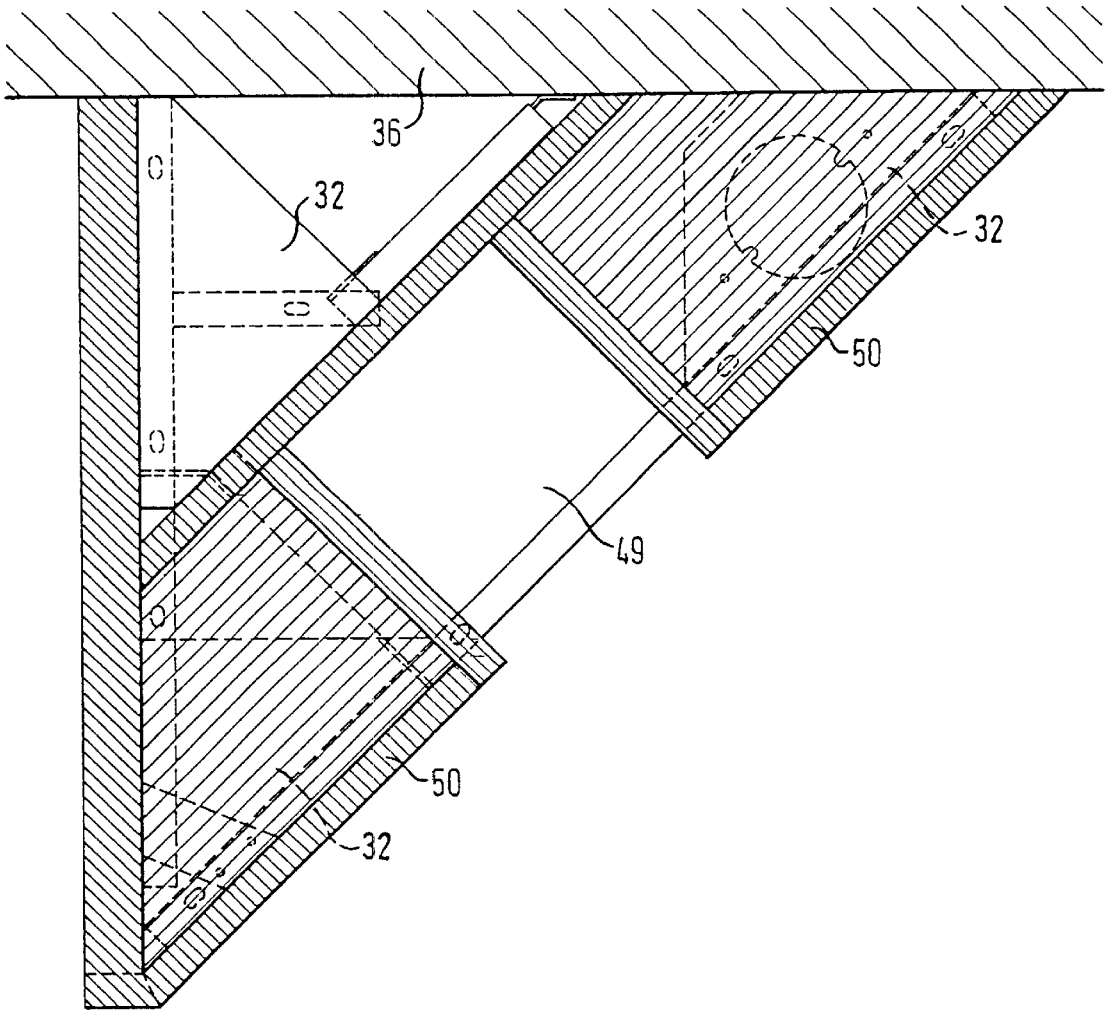
FIG. 22 illustrates the arrangement of FIG. 20 after cladding has taken place.

FIG. 22 shows the arrangement of FIG. 20 after external cladding has been carried out. The cladding can be fixed without problem and with accurate fitting to the precisely extending components of the overall construction, for example by adhesive bonding or screwing. In this respect aesthetically particularly attractive room utilizations which are also correct in practice can be achieved in that free spaces 49 present between adjacent functional modules can be exploited for the mounting or integration of bathroom furniture, mirror cabinets and the like. All known and customary materials can be used as the material for the cladding 50.

Figure 23:
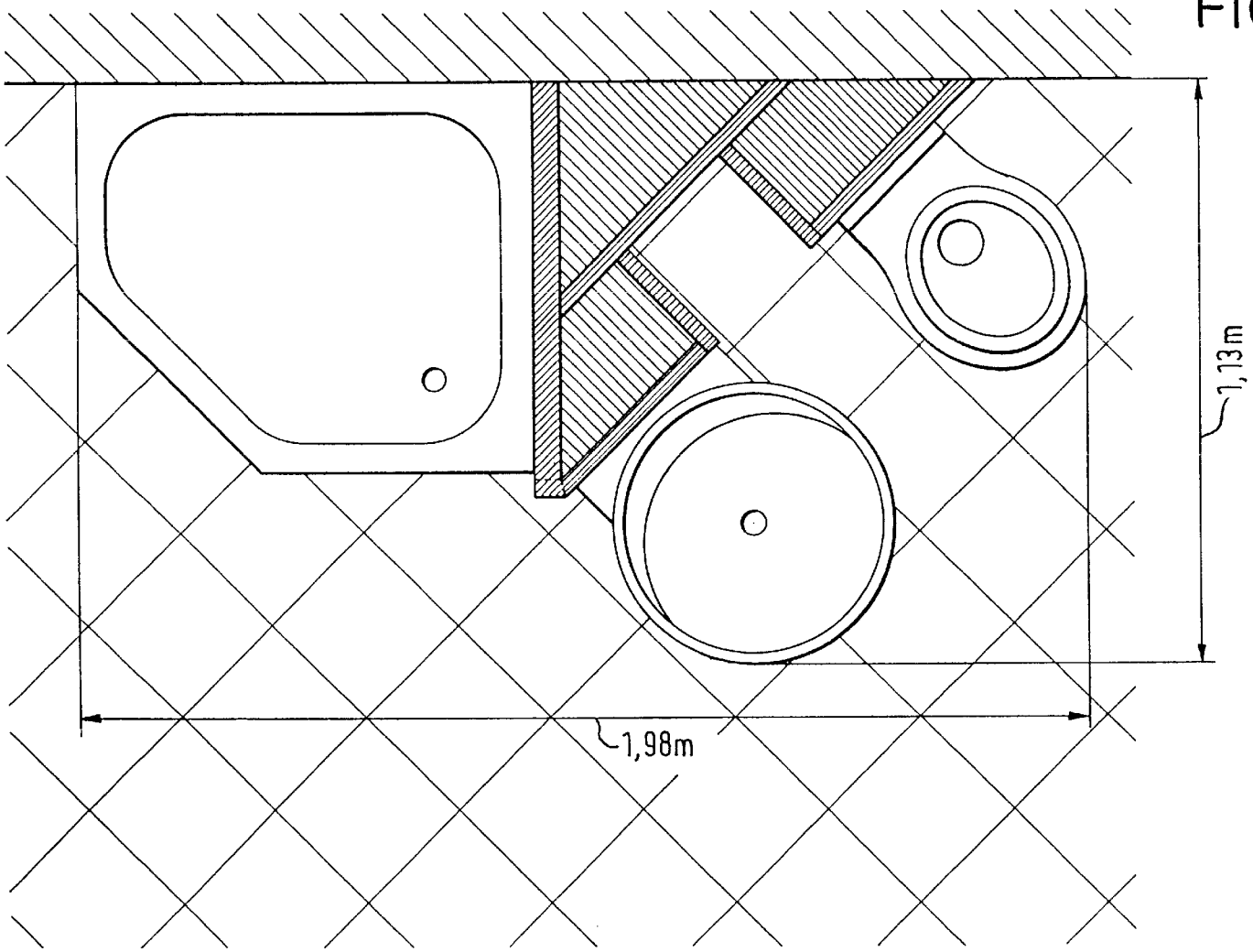
FIG. 23 illustrates a schematic plan view of the arrangement of FIG. 22 after having been equipped with sanitary objects in a room.

FIG. 23 shows in the form of a plan view a section of a bathroom which is equipped with the clad installation unit of FIG. 22 and accordingly includes a WC, a washstand and a shower tub and in doing so makes do with a minimum place or space requirement, as is also brought out by the dimensions which have been entered as an example.

Figure 24:
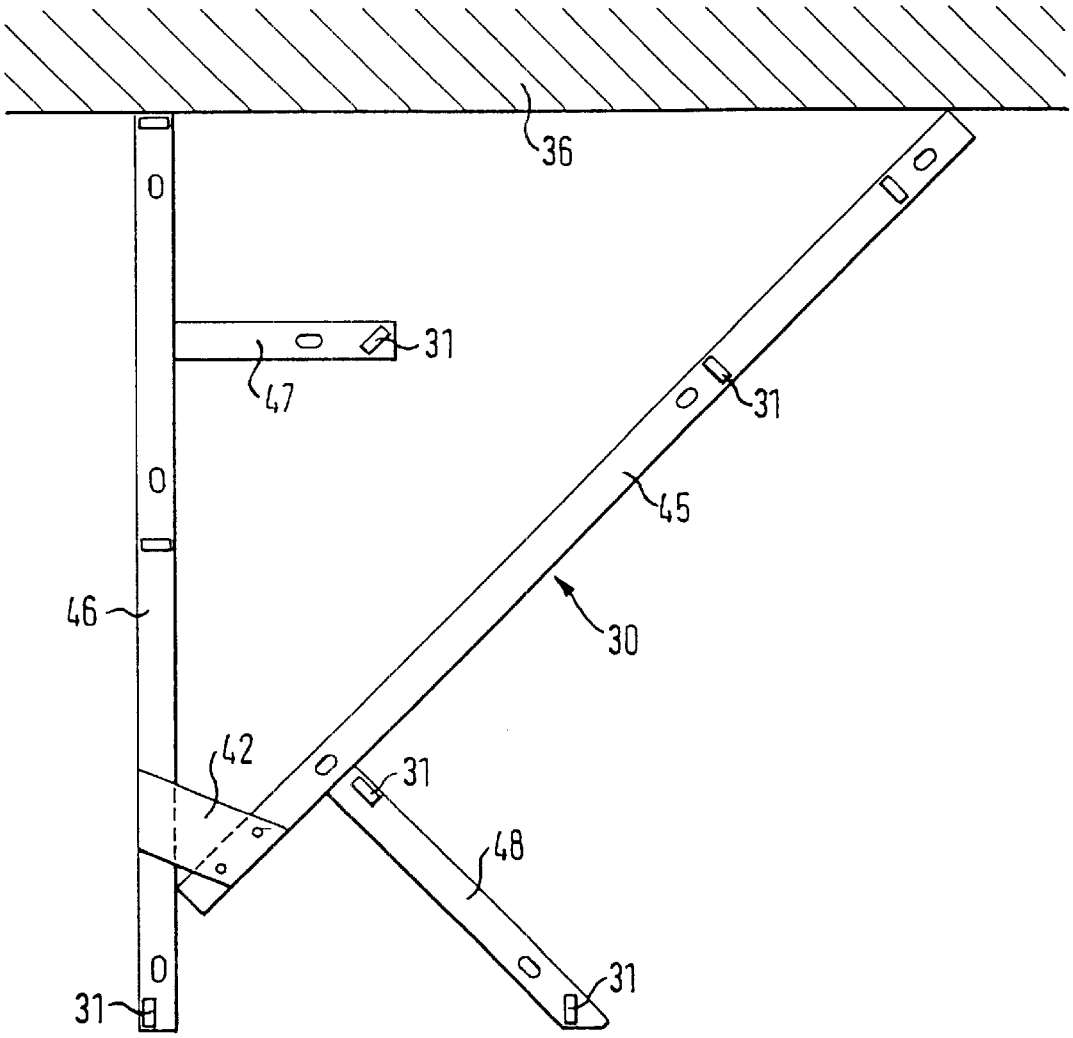
FIG. 24 illustrates a further embodiment of a foundation arrangement.

FIG. 24 shows a foundation 30 of a further advantageous variant of the invention. The foundation elements 45, 46, 47 and 48, which are secured to the rough concrete floor, are again intended for the mounting of three functional modules 32 with it being possible to obtain a changed subdivision of space opening up new design possibilities through the relative positioning of the foundation elements in comparison to FIG. 15. The obliquely extending foundation element 45 is set back with respect to the free end of the foundation element 46 extending perpendicular to the wall 36 and is connected to the element 46 via a connection lug 42.

Through right-angled mounting of the short foundation element 48 onto the obliquely extending foundation element 45 a mount is provided for a functional module which is disposed outside of the inner space bounded by the two long foundation elements 45, 46 and the wall 34. The foundation elements are in turn provided with module carriers 31, which are of rectangular cross-section in the selected example, with their longitudinal axis directed relative to the respective longitudinal axis of the foundation element, so that a form-fitted reception of these module carriers 31 in the associated hollow sections 33 of the functional modules 32 is possible.

Figure 25:
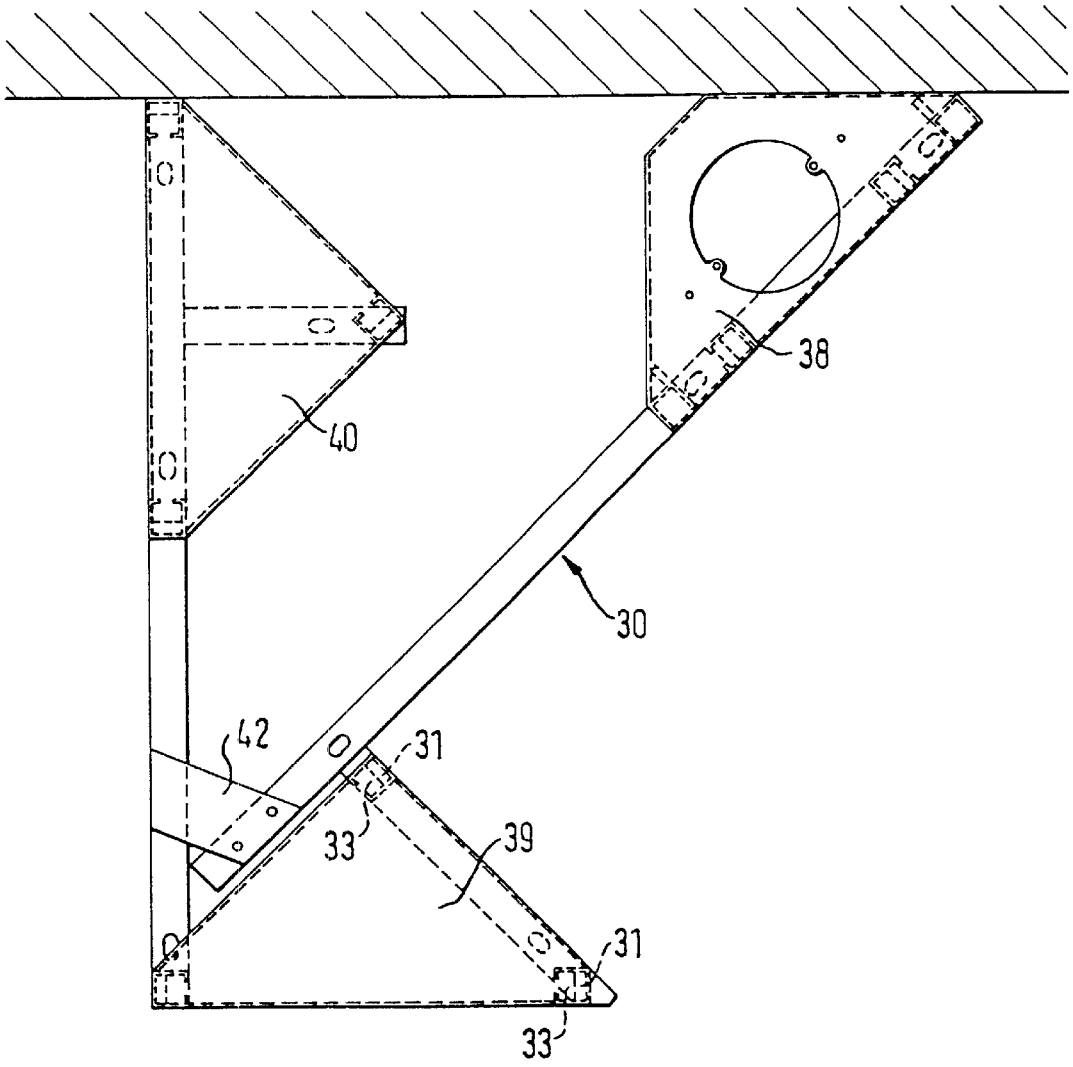
FIG. 25 illustrates the foundation arrangement of FIG. 24 after being equipped with functional modules.

FIG. 25 shows the foundation 30 after the placement of the functional modules 32 on the module carriers 31 and it should in turn be mentioned that the module carriers 31 can be permanently clamped in force-transmitting manner to the hollow sections 33, in particular in form-locked and force transmitting manner, and indeed at the respectively desired height.

Figure 26:
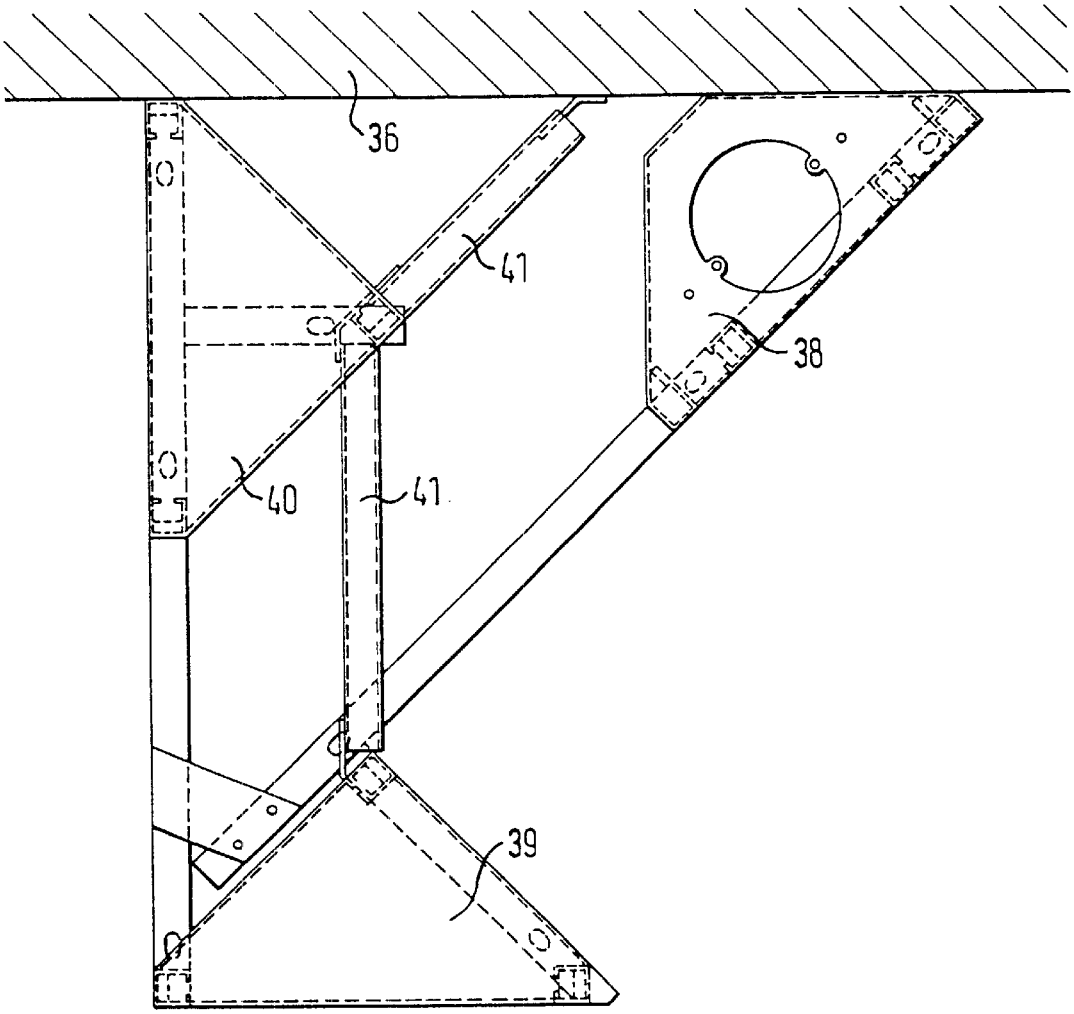
FIG. 26 illustrates the arrangement of FIG. 25 after being supplemented with stabilizers.

FIG. 26 shows the arrangement of FIG. 25 after the supplementary mounting of stabilizing elements 41 between the functional module for the washstand connection unit 39 and the functional module for the connection unit for a tub or shower fitting 40 and also between the functional module 40 and the wall 36. The functional module for the WC flushing unit 38 is additionally screwed to the wall 36, so that in total a very stable overall unit results.

Figure 27:
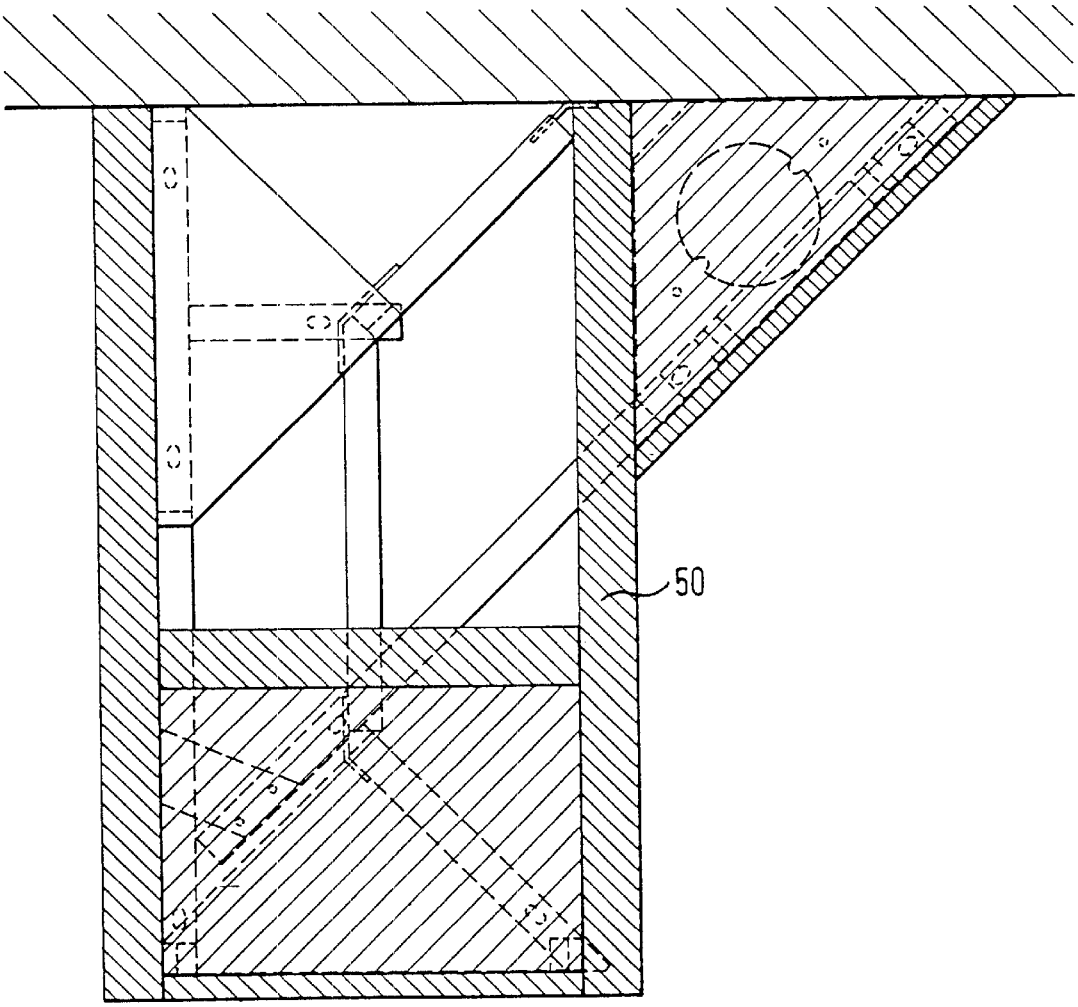
FIG. 27 illustrates the arrangement of FIG. 26 after cladding has been completed.

FIG. 27 shows the arrangement of FIG. 26 after the attachment of the cladding 50 to the outer surfaces of the overall unit. A comparison of this FIG. 27 with FIG. 22 makes it clear that despite a very similar basic layout of the technical units a fundamentally different arrangement can be achieved design-wise, which makes the high degree of variability of the installation unit of the invention clear.

Simply as a supplement it should be noted that the respective cladding is suitable for the mounting of tiles, sheets of marble or other cladding elements and that washstand surface boards and the like can be fixed to the unit.

Connection fittings, fitting mounts, flushing containers and the like are mounted in a manner decoupled with respect to structure-borne noise inside the individual functional modules. As a rule the installation unit is mounted on a rough floor. In the case of installation on flooring plaster or on a finished floor, sound decoupling elements consisting of softly resilient materials are provided between the mounting wall 36 and the functional modules 32.

Moreover, the functional modules enable the connection of all sanitary articles usual in the market place.

What is claimed is:

1. An installation unit for sanitary fixtures comprising:

at least one foundation, the foundation comprising:

at least two foundation elements fixable relative to one another at predeterminable angles forming at least one acute angled corner region;

at least two vertically extending module carriers; and at least one functional module coupled to the at least two vertically extending module carriers, wherein the at least one functional module comprises a plurality of carrying elements formed as a plurality of hollow sections arranged in a plurality of corner regions of the at least one functional module, wherein the plurality of hollow sections are coupled to the at least two vertically extending module carriers so that their spacing to the foundation is adjustable, wherein the at least one functional module is of a polygonal contour and forms a stable assembly together with the foundation and the at least two vertically extending module carriers and the functional module is arranged in the at least one acute angled corner region.

2. The installation unit in accordance with claim 1, wherein the polygonal contour is a triangular peripheral contour.

3. The installation unit in accordance with claim 1, wherein the plurality of module carriers are a different height and are attached to the at least one foundation and at least a part of the plurality of module carriers is adjustably secured to the associated at least one foundation at different positions.

4. The installation unit in accordance with claim 1, wherein the at least two foundation elements are elongated.

5. The installation unit in accordance with claim 1, wherein the at least two vertically extending module carriers are of a flat, bar-like design and are secured to the at least two foundation elements, wherein the at least two vertically extending module carriers comprise an end face at predeterminable angles to a longitudinal axis of the plurality of elongated foundation elements.

6. The installation unit in accordance with claim 1, further comprising a plurality of stabilizing elements, wherein the stabilizing elements are coupled to the hollow sections.

7. The installation unit in accordance with claim 6, wherein the at least one functional module comprises at least two functional modules and the at least two functional modules are connected to one another via these stabilizing elements.

8. The installation unit in accordance with claim 1, wherein the at least two foundation elements are straight.

9. The installation unit in accordance with claim 1, wherein the at least two foundation elements are curved.

10. The installation unit in accordance with claim 1, wherein the at least two foundation elements are aerial.

11. The installation unit in accordance with claim 1, wherein the predetermined angles are acute angles.

12. The installation unit in accordance with claim 11, wherein the acute angle is an angle of 45°.

13. The installation unit in accordance with claim 1, wherein the at least two foundation elements have their spaced-apart ends extending up to a wall, wherein a first foundation element of the two foundation elements comprises a shorter foundation element, which extends outwardly perpendicular to the wall, wherein a second foundation element of the at least two foundation elements extends obliquely to the wall and comprises in each of its two end regions a first and second module carrier, wherein the first foundation element comprises a third module carrier at a free end of the first foundation element, wherein the first, second, and third module carriers are for the reception of the at least one functional module.

14. The installation unit in accordance with claim 13, further comprising an additional short foundation element connected at right angles to the first foundation element extending perpendicular to the wall and extending inwardly with a spacing from the wall.

15. The installation unit in accordance with claim 13, wherein the second foundation element extending obliquely to the wall is coupled at its wall side end region via the plurality of module carriers to a WC functional module, wherein the WC functional module is fixed at the wall side.

16. The installation unit in accordance with claim 13, wherein the first foundation element extending perpendicular to the wall receives a functional module as a carrier.

17. The installation unit in accordance with claim 13, wherein the functional module is a shower.

18. The installation unit in accordance with claim 13, wherein the functional module is a tub fitting.

19. The installation unit in accordance with claim 1, wherein the functional module comprises WC, washstand, bathtub, shower, bidet, urinal, and pipes.

* * * * *